US005819662A

United States Patent [19]

Koyabu

[11] Patent Number: 5,819,662

[45] Date of Patent: Oct. 13, 1998

[54] PRINTER

[75] Inventor: Akira Koyabu, Nagano, Japan

[73] Assignee: Seiko Epson Corporation, Tokyo, Japan

[21] Appl. No.: 623,711

[22] Filed: Mar. 29, 1996

[30] Foreign Application Priority Data

Mar. 29, 1995 [JP] Japan ..... 7-072138

[51] Int. Cl.[6] ..... B41F 1/28

[52] U.S. Cl. ..... 101/474; 400/642; 400/656

[58] Field of Search ..... 400/59, 56, 55, 400/57, 622, 647, 642, 474, 525, 528, 536, 656; 101/474

[56] References Cited

U.S. PATENT DOCUMENTS

| | | | |
|---|---|---|---|
| 1,997,077 | 4/1935 | Racz et al. | 400/642 |
| 2,860,430 | 11/1958 | McKewen | 400/642 |
| 4,024,942 | 5/1977 | Kawaji | 400/642 |

FOREIGN PATENT DOCUMENTS

| | | | |
|---|---|---|---|
| 2-116576 | 5/1990 | Japan . | |
| 3-61565 | 5/1991 | Japan | 400/56 |

*Primary Examiner*—Edgar S. Burr
*Assistant Examiner*—Daniel J. Colilla
*Attorney, Agent, or Firm*—Sughrue, Mion, Zinn, Macpeak & Seas, PLLC

[57] ABSTRACT

A printer including a paper guide auxiliary member for guiding recording paper to the vicinity of the lower end of a printing area in which a print head performs printing, a paper side regulating member formed of elastic material for guiding both sides outside of the printing area of recording paper transferred from the paper guide auxiliary member towards the exit of the recording paper, and a gap forming member located outside of recording paper path and pressed between the paper side regulating member and platen. The recording paper is guided along the platen by the paper side regulating member while being transferred in the predetermined gap formed between the paper side regulating member and platen without frictional force, thereby avoiding the need for a mask plate which often causes problems.

15 Claims, 5 Drawing Sheets

PRINTER

BACKGROUND OF THE INVENTION

1. Field of the Invention

The present invention relates to a printer used, for example, for a Point-Of-Sales (POS) system or an electronic cash register (ECR), and particularly to a technique for guiding a recording paper in the printer.

2. Description of the Related Art

FIGS. 5 and 6 show a typical example of a printer according to the related art. FIG. 6 is a schematic view from the side of the printer, and FIG. 5 is a perspective view showing the printing section.

The figures show a wire dot printer in which a printing wire strikes a recording paper via an ink ribbon to print a character or image information. An ink ribbon cassette (not shown) which houses an ink ribbon to be supplied to a printing section is disposed at the front (on the right side of FIG. 6) of the printer, and a carriage 2, on which a wire dot head 1 is mounted, is moved in the direction parallel to printing lines. A roll 20 of recording paper 21 is housed in the rear part of the printer. Upper paper guide 8 and lower paper guide 7 are arranged so that there is gap between them, which gap regulates a position of the recording paper 21 in both width and thickness directions.

Paper feeding roller 12 acts as a paper feeding means and is fixed on paper feeding shaft 13 of which rotation is controlled, and paper pressing roller 14 presses against the periphery of the paper feeding roller 12.

Further, a platen 11 is disposed opposite the wire dot head 1 on the downstream side in the paper feed direction, and a manual cutter 4 is disposed above the platen.

Carriage 2 is constituted so that it can slide on both guide shaft 5 and auxiliary guide shaft 5*a* so as to be disposed in parallel with the platen 11, and the carriage can be moved along platen 11 by a spacing drive system (not shown).

Mask plate 3 is provided with a hole through which the dot wires pass. The mask plate 3 is attached to the carriage 2 and presses the recording paper in the vicinity of a printing position on platen 11.

In the printer described above, recording paper 21 pulled out from the roll 20 is carried by a paper feeding means formed by the paper feeding roller 12 and the paper pressing roller 14, and is moved to the manual cutter 4 after passing mask plate 3 which is pressed against platen 11.

Then, after desired printing is performed on recording paper 21 by wire dot head 1 mounted on carriage 2, paper is fed by a predetermined amount and then cut in a predetermined position with manual cutter 4.

However, according to the above-described prior art, in some cases recording paper carried by the paper feeding means cannot pass through a contact point of mask plate 3 and platen 11, particularly if thin recording paper with low rigidity is used, because mask plate 3 is pressed against platen 11 at that point. This results in paper jamming.

If the carriage is positioned at either end of a recording area when waiting for a printing command, recording paper may be fed with a skew due to the load of mask plate 3, and similarly a paper jam occurs.

Further, if the leading edge of recording paper is curled toward wire dot head 1, the leading edge comes in contact with and is stopped by jaw 3*a* of mask plate 3 when recording paper is set in the printer, and similarly a paper jam occurs.

Furthermore, when carriage 2 is moved while the recording paper jam occurs in the vicinity of a printed portion of recording paper, the mask plate attached to carriage 2 is deformed easily because mask plate 3 is usually formed as a thin plate, and such deformation often results in serious damage to the printer.

Meanwhile, if recording paper is thick and rigid, the recording paper does not have enough contact with platen 11 to avoid problems such as breakage of wire in the wire dot head and increase of a printing sound in the case of impact dot printers. Further, if an ink ribbon is disposed on a printer frame facing the overall width of recording paper, the recording paper often becomes dirty with ink received from the ink ribbon.

SUMMARY OF THE INVENTION

The present invention is made to solve the above described problems, and its object is to provide a printer with high reliability wherein the operability of recording paper is enhanced, no paper jams and other failures seldom occur.

To solve the above-described problems, a printer of the present invention comprises: a platen member; a paper guide auxiliary member for guiding recording paper supplied to a printing surface of said platen member; a paper side regulating member for guiding a side portion of the recording paper passing through said paper guide auxiliary member; and a gap forming member located outside a recording paper path in which the recording paper is transferred and for providing a minimum predetermined gap between said paper side regulating member and the printing surface of said platen member; wherein gap forming member comprises a projection formed on one of said platen member and said paper side regulating member, said projection contacting the other one of said platen member and said paper side regulating member to maintain said predetermined minimum gap.

In the printer according to the present invention as described above, the paper side regulating member and the platen do not touch each other, and a minimum gap is secured therebetween. Therefore, there is provided a printer with enhanced reliability, wherein the recording paper is smoothly set because no running load is imposed even if the recording paper is thin and flexible. Consequently, paper jams do not occur when the recording paper is inserted. As recording paper is readily touched to the platen without being separated greatly from the platen by being regulated along the platen by the paper side regulating member, a printing sound is low and a mask plate attached to the carriage in the conventional printer can be removed.

Further, since the gap between the paper side regulating member and printing surface of the platen member is determined to be the predetermined value by the gap forming member, there are no problems of print quality deterioration and high noise level caused by recording paper vibration which is caused by a large paper transportation gap. Therefore, it is possible to provide a silent printer with a higher quality and lower price because it is not required to form the paper side regulating member with high accuracy.

The gap forming member may be formed on the platen or the paper side regulating member.

As described above, the gap forming member may be a projection provided on the platen member or paper side regulating member, and therefore a further cost reduction is enabled.

Furthermore, since the paper side regulating member can be integrated with the paper guide auxiliary member, the number of parts can be reduced and further cost reduction is enabled.

Furthermore, a manual cutter may be disposed downstream of the printing surface of the platen in a direction in which the recording paper is transferred, the paper side regulating member extending at least to the manual cutter along the recording paper path.

The paper side regulating member substantially supports the bottom and top of the recording paper, and a deformation load is therefore larger compared with a single support structure, the paper side regulating member strongly pressing against the bulge of the recording paper. As a result, the recording paper is returned in the recording paper path by this load even if the direction of movement of the recording paper is forced to be changed greatly when it is cut. Consequently, a paper jam problems are prevented and the reliability of the printer is enhanced. Further, when printing is performed after the recording paper is cut, a line on which printing is performed and the next printing line are the same in a horizontal paper feed amount because the recording paper has returned to its standby position, and printing alignment is greatly enhanced.

Furthermore, the manual cutter comprises a skirt section for guiding the leading edge of the recording paper in the recording paper path as the recording paper is transferred from the printing surface along the paper side regulating member. The manual cutter pivoted, and the paper side regulating member urges the manual cutter to be set at a predetermined position in which the skirt section of the manual cutter guides the recording paper into the recording paper path.

If a printer is constructed as described above, the standby position of the manual cutter is secured, and as a result, a spring for the manual cutter is not required and further cost reduction is enabled.

DETAILED DESCRIPTION OF THE PREFERRED EMBODIMENT

An embodiment according to the present invention will be described referring to FIGS. 1 to 4.

A printer according to the present embodiment has almost the same basic constitution as one of the general serial wire dot printer described in the Background section. In FIGS. 1 to 4, the same reference numbers are assigned to the same or equivalent parts as that in the related printer, and accordingly explanations of these parts will be omitted.

In the present embodiment, the gap forming member is formed as a part of the paper side regulating member, and further, the paper side regulating member is integrated with the paper guide auxiliary plate.

Figure 1A:
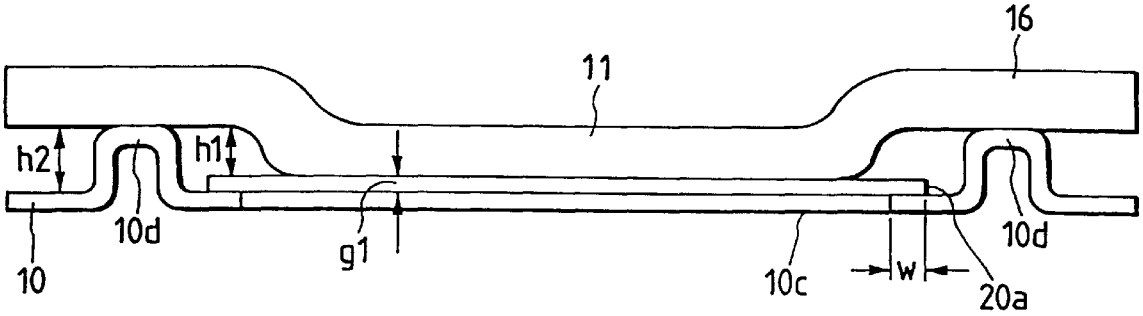
FIG. 1A is a schematic cross sectional top view explaining a relationship between platen 11 and paper side regulating member 10*b* of a printer according to an embodiment of the present invention.
Figure 2:
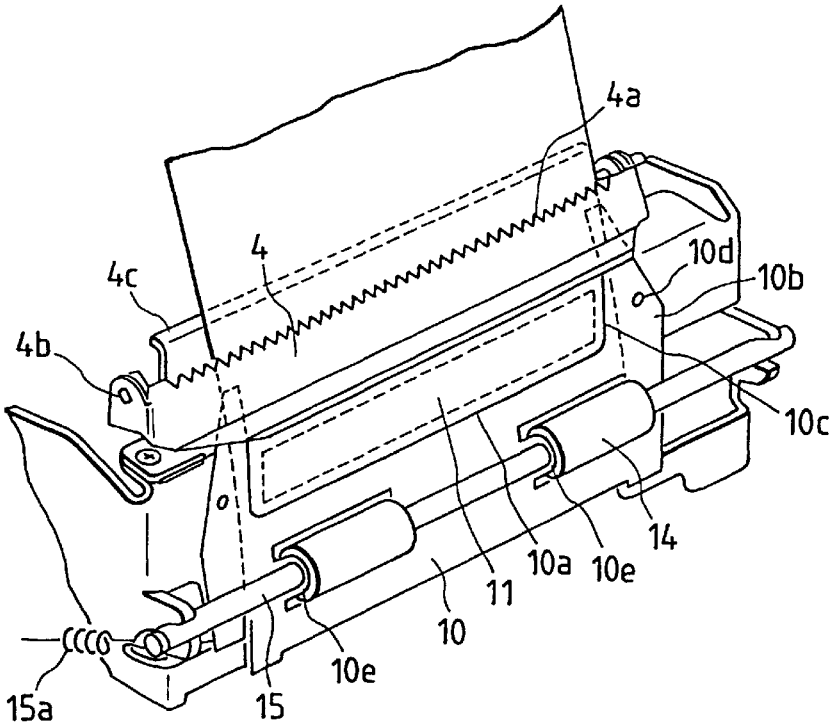
FIG. 2 is a schematic perspective view of the vicinity of a printing section according to the embodiment.
Figure 1B:
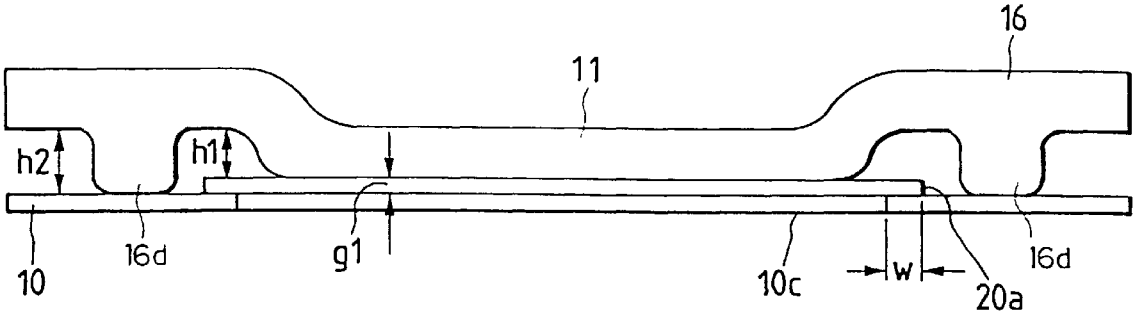
FIG. 1B is a schematic cross sectional top view explaining a relationship between platen 11 and paper side regulating member 10*b* according to a variation of the embodiment in FIG. 1A.
Figure 3:
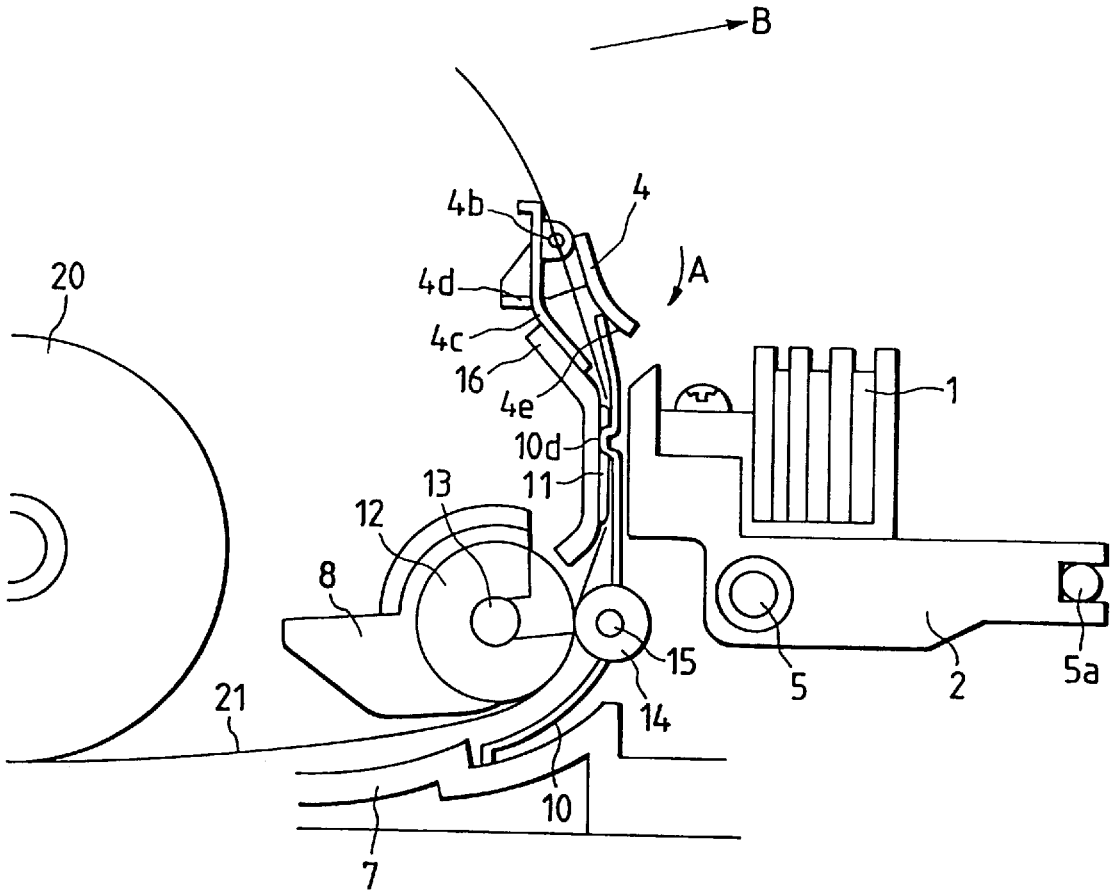
FIG. 3 is a schematic side view around the recording paper path showing guide members of a recording paper according to the embodiment.
Figure 4:
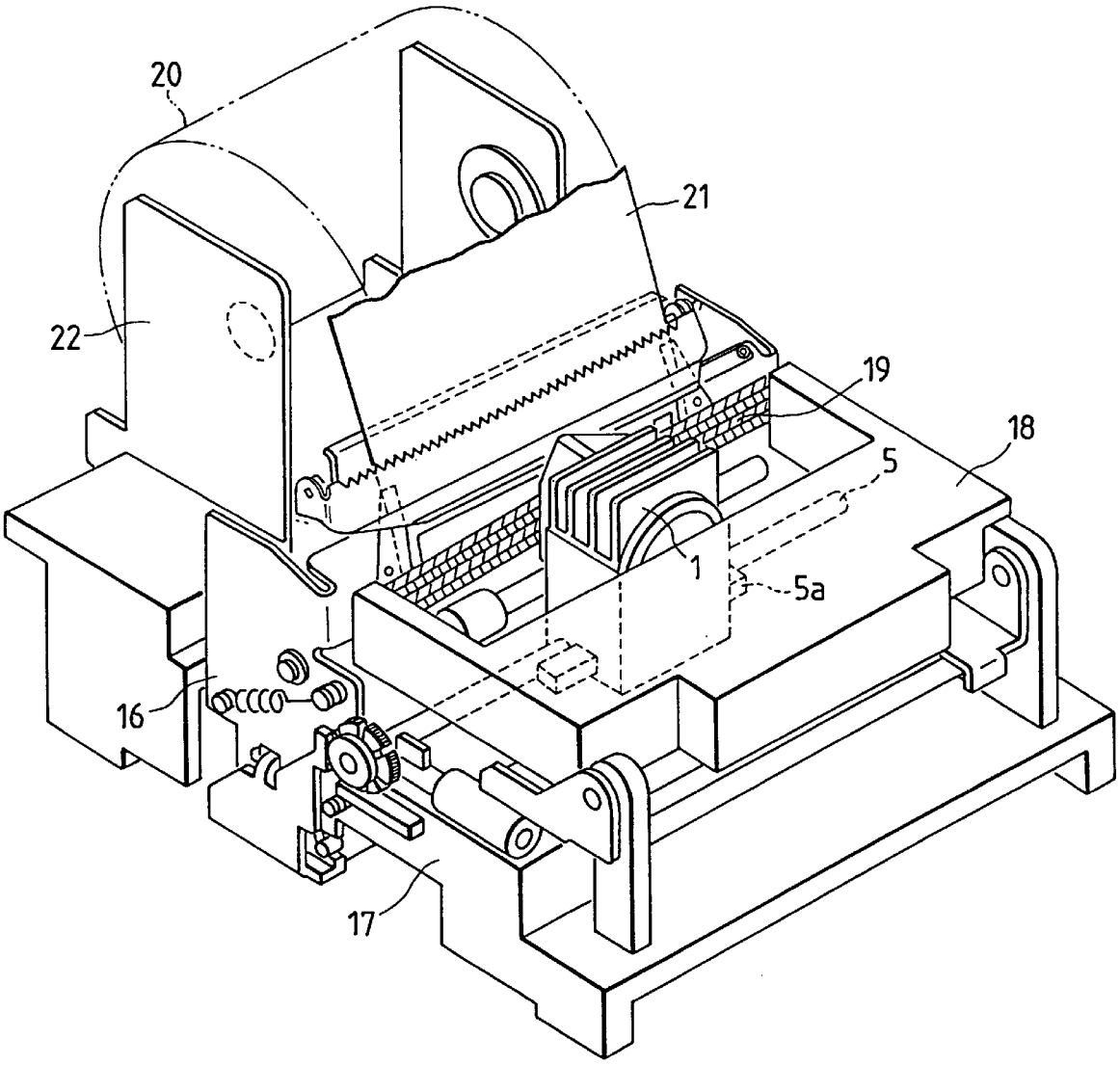
FIG. 4 is a perspective view of a printer according to the embodiment.
Figure 5:
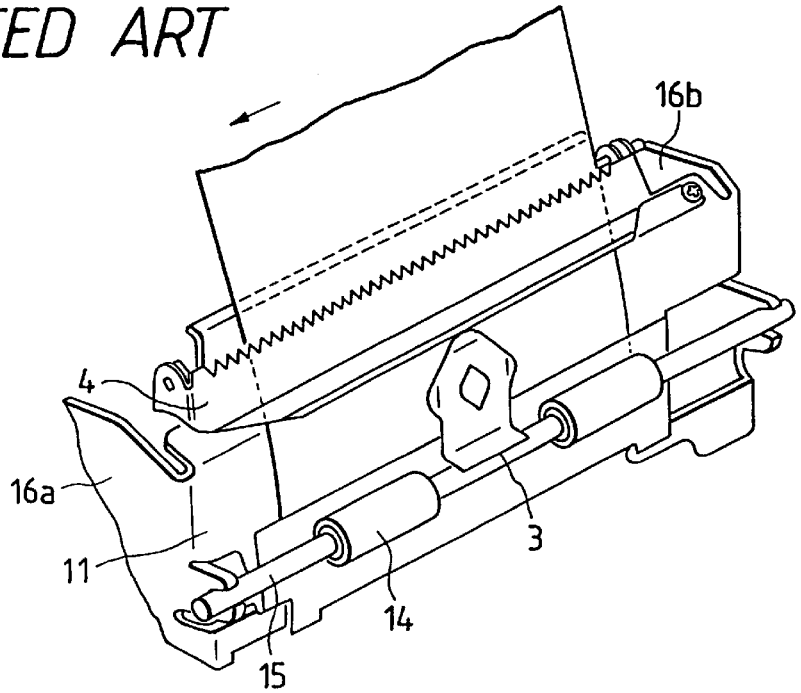
FIG. 5 RELATED ART
FIG. 5 is a schematic perspective view of the vicinity of a printing section according to the related art.
Figure 6:
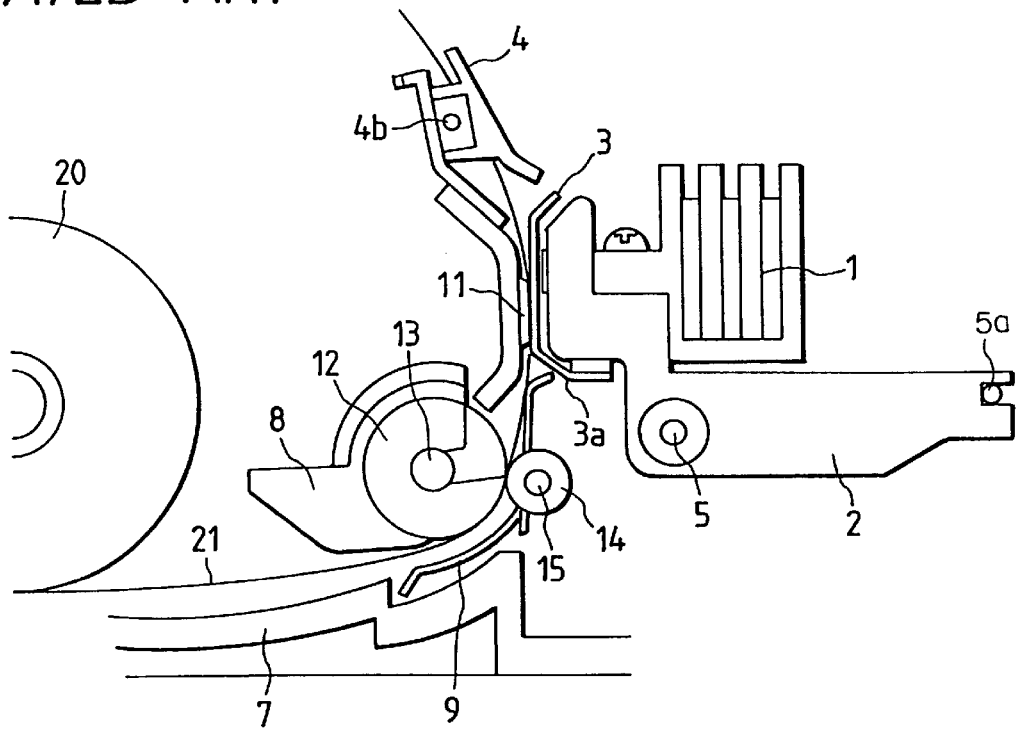
FIG. 6 RELATED ART
FIG. 6 is a schematic side view around the recording paper path showing the guide structure of a recording paper according to the related art.

FIG. 4 is a perspective view of the overall printer, FIG. 3 is a schematic cross sectional side view of the main part of the printer, FIG. 2 is a schematic perspective view of the vicinity of the platen in the printing section and FIG. 1 is a schematic cross sectional top view explaining a relationship between platen 11 and paper side regulating member 10*b* of a printer according to an embodiment.

In a printer according to the embodiment, printing is performed on the recording paper 21 which pulled out from a roll 20 disposed in the rear part of the printer. An ink ribbon cassette 18 is disposed in the front part of the printer.

A printer according to this embodiment is mainly constituted by base frame 17 formed of resin integrated with holder 22 for the roll paper, main guide shaft 5 and auxiliary guide shaft 5*a* disposed inside base frame 17, carriage 2 on which wire dot head 1 is mounted, the carriage 2 being moved along main guide shaft 5, platen frame 16 attached to base frame 17 and opposing main guide shaft 5, ink ribbon 19, paper feeding roller 12 for transferring the recording paper, paper guide auxiliary plate 10 for regulating the recording paper so as not to be separated from platen 11, and manual cutter 4 provided with blade 4*a* for cutting the recording paper.

In the printer according to the embodiment, ribbon cassette 18 housing ink ribbon 19 is further disposed on a holder which is pivotally mounted on base frame 17 allowing ribbon tracks of ink ribbon 19 to be selected in response to a demand for the printing.

A platen 11 protrudes from the surface of platen frame 16 opposing wire dot head 1 and is formed using an embossing process. The platen 11 is configured so that it is in parallel with main guide shaft 5. Platen frame 16 is pivotally attached to the base frame 17 so that the gap between platen 11 and wire dot head 1 can be adjusted to a predetermined value.

For adjusting a gap between the platen and the wire dot head, generally, a gap gauge is inserted between wire dot head 1 and platen 11. Since platen 11 protrudes towards wire dot head 1, the gap is readily adjusted and the operability is enhanced. The geometrical moment of inertia is increased by forming the face of platen 11 by an embossing process, and therefore, the rigidity of the platen 11 is increased, and the platen 11 is not easily deformed. Further, even if the flatness of the platen portion of the platen frame 16 is not to specification, it will satisfy the specification as a result of the embossing process.

Manual cutter 4 is made of a metallic plate such as a stainless (SUS) plate or formed of transparent resin such as polycarbonate at the top of which is disposed blade portion 4*a* having plural sharp teeth, like a saw blade.

Manual cutter 4 is also attached to cutter mounting plate 4*c* with shaft 4*b* in the center so that manual cutter 4 can swing about shaft 4*b* in a predetermined range in the direction shown by an arrow A. Manual cutter 4 has a stopper section 4*d* disposed on the side of manual cutter 4 in contact with cutter mounting plate 4*c* to stop movement of the manual cutter 4 when turning in the direction opposite to the arrow A. Manual cutter 4 contacts paper side regulating member 10*b*, which is formed of elastic material, on an inside surface of manual cutter 4, and the paper side regulating member 10*b* always urges manual cutter 4 to turn in the direction opposite to the arrow A. Manual cutter 4 is stopped at a standby position where stopper section 4*d* of manual cutter 4 abuts cutter mounting plate 4*c*, and therefore the lower side of manual cutter 4 opens wide. Accordingly, recording paper 21 transferred from platen 11 is not interfered with by skirt 4*e* of manual cutter 4.

When a gap gauge is inserted in the printing section to measure and adjust the platen gap, the gap gauge can easily turn manual cutter 4 in the direction of arrow A to remove skirt 4*e* from the insertion path by contacting skirt 4*e*, thus facilitating the platen gap adjustment.

Further, since shaft 4*b*, about which manual cutter 4 pivots, is disposed at approximately the same height as blade 4*a*, there is no moment force which would tend to turn manual cutter 4. Therefore, when recording paper 21 is pulled in the direction of arrow B to cut recording paper 21, recording paper 21 is bent by the blade 4*a* and is cut when it is pulled further in the direction of arrow B.

Since both ends of cutter mounting plate 4*c* are detachably fixed on platen frame 16 by screws, it is easy to attach and detach cutter mounting plate 4*c* to and from platen frame 16, thus making it easy to change the printer configuration to meet another printer specification requiring manual cutter 4 to be removed.

Paper feeding roller 12 is formed of a material with a high friction coefficient such as rubber and fixed on paper feeding shaft 13 which is driven by a paper feed motor (not shown) and is attached to base frame 17.

Paper pressing roller 14 is attached to paper pressing shaft 15 so that the roller can be rotated. The paper pressing roller 14 presses paper feeding roller 12 by paper pressing spring 15*a* attached to each of the ends of paper pressing shaft 15.

Recording paper 21 is carried to the printing section while being pressed between paper feeding roller 12 and paper pressing roller 14.

A lower paper guide 7 is integrated with the base frame 17 formed of resin. Lower paper guide 7 and upper paper guide 8 form the path for recording paper 21, and these upper and lower paper guides regulate not only the thickness of recording paper but also the width of the recording paper.

Paper guide auxiliary plate 10 for guiding recording paper 21 from lower paper guide 7 to manual cutter 4 is formed of a thin stainless (SUS) spring material of 0.15 mm thickness. Two openings are provided in paper guide auxiliary plate 10 through which paper pressing roller 14 is pressed against the paper feeding roller 12. Further, fittings 10*e* provided with an elongated hole are formed on both sides of the openings so that paper pressing roller shaft 15 is inserted in the elongated holes and can be moved towards paper feeding roller 12 by paper pressing spring 15*a*.

The center of upper end 10*a* of paper guide auxiliary plate 10 is located immediately under a locus of the wires of the wire dot head 1, i.e., the printing area. Therefore, recording paper 21 is regulated by paper guide auxiliary plate 10 in such a manner that the recording paper is not stuck out towards carriage 2 up to a portion immediately under the printing area of wire dot head 1.

Paper guide auxiliary plate 10 is extended towards manual cutter 4 in both of its sides outside of the printing area forming paper side regulating member 10*b*. The gap forming member 10*d* protruding towards platen 11 is formed on paper side regulating member 10*b* (see FIG. 1A) in order to prevent paper side regulating member 10*b* from contacting platen 11 or platen frame 16 in the recording paper path. Alternatively, a gap forming member 16*d* can be formed on the platen frame 16. In this embodiment, the protruding height h2 of gap forming member is 0.4 mm and the drawn height h1 of platen 11 is 0.3 mm. Therefore, gap (g1) between platen 11 and paper guide auxiliary plate 10 becomes 0.1 mm according to the following equation.

$$g1=0.4-0.3=0.1\ (\text{mm})$$

Accordingly, 0.1 mm gap is maintained.

Gap forming member is disposed so as to prevent paper side regulating member 10*b* from abutting platen 11 or platen frame 16 even if paper side regulating member 10*b* is deformed by manual cutter 4.

In the embodiment, the manual cutter 4 is held in the standby position using the elastic force of paper side regulating member 10*b*. However, the manual cutter may be held in a standby position by providing a torsion coil spring or another elastic member, such as is well known to those skilled in the art, to manual cutter 5 and cutter mounting plate 4*c*. Note that the number of parts can be reduced when paper side regulating member 10*b* of paper guide auxiliary plate 10 functions as the elastic member for urging manual cutter 4 as described in the embodiment above, thus reducing both size and cost of the printer.

Next, an operation in which recording paper 21 is set in the printer will be described.

Recording paper 21 pulled out of paper roll 20 is inserted into the recording paper path formed between lower paper guide 7 and upper paper guide 8, and is led to a pressing section where paper feeding roller 12 and paper pressing roller 14 are pressing against each other. The recording paper is carried to the printing section by paper feeding roller 12 while being held between paper feeding roller 12 and paper pressing roller 14.

Further, recording paper 21 is carried to manual cutter 4 while both sides of the recording paper are guided by paper side regulating member 10*b* of paper guide auxiliary plate 10. As described above, a gap between paper side regulating member 10*b* and a lower portion of platen frame 16 from which platen 11 protrudes is 0.4 mm, and recording paper 21 is carried to manual cutter 4 without deforming paper side regulating member 10*b*. Referring to the recording paper, a majority of the available recording paper used for ECR and so on is 45 to 55 Kg in weight of 1000 sheets of 788 mm ×1091 mm sized paper and is 0.07 to 0.1 mm in thickness.

Accordingly, since a gap between platen 11 and paper side regulating member 10*b* is 0.1 mm wide as described above, recording paper is carried approximately flatly without being curved at both sides, or at the center of recording paper 21 (see FIG. 1). As described above, recording paper 21 is carried to manual cutter 4 without generating any effective frictional force at both sides which are guided by paper side regulating member 10*b* and denoted as W in FIG. 1, because the gap between paper side regulating member 10*b* and platen 11 is equal to or larger than the thickness of recording paper 21. Therefore, paper jamming can be avoided even when thin recording paper with low rigidity is used as the recording paper 21.

When the recording paper 21 is carried further, both sides of the recording paper 21 are guided to manual cutter 4 by paper side regulating member 10*b*. While the paper is carried, it sometimes occurs that the center of recording paper sticks out toward wire dot head 1 apart from platen 11 because recording paper 21 is guided only at its sides by paper side regulating member 10*b*. However, even in this case, the central portion of recording paper 21 is guided and aligned by skirt 4*e* of manual cutter 4 to be carried along platen 11. Since the lower end of skirt 4*e* and the top of the wire dot head 1 are overlapped, recording paper 21 is smoothly guided to the recording paper path even if reverse curl exists at the leading edge of recording paper 21, thus preventing recording paper 21 from jamming.

Next, the case in which recording paper 21 is cut by manual cutter 4 will be described in detail.

After a printing process in which a predetermined character or image is printed on recording paper 21 by wire dot head 1, recording paper 21 is further carried by a predetermined amount so as to be located in a position in which recording paper 21 is cut by blade 4*a* of manual cutter 4. Then, an operator pulls the upper end of recording paper 21 in the direction of arrow B to cut recording paper 21 using blade 4*a*.

In this case, the operator pulls recording paper 21 obliquely against manual cutter 4 and cuts recording paper 21 from either side with blade 4*a*, so that stress is applied continuously to cut recording paper with a relatively small force. Therefore, recording paper in contact with the manual cutter 4 is sometimes shifted to either side in the recording paper path on which recording paper is pulled to be cut.

Since gap forming member 10*d* of paper side regulating member 10*b* prevents recording paper 21 from being pressed against platen 11, recording paper 21 can easily move in the width direction in the recording paper path. Therefore, if recording paper 21 is shifted as described above, it is certain that recording paper is aligned by an elastic force after cutting is completed. Therefore, the recording paper 21 will not stick out inside the carriage moving path, thus preventing recording paper jamming, and improving the reliability of the printer.

Next, the case in which the thickness of recording paper 21 exceeds 0.1 mm will be described.

when recording paper 21 is set in the printer, it is curved by paper side regulating member 10*b* because the gap between platen 11 and paper side regulating member 10*b* is 0.1 mm, and thus a small running load is applied to both sides. However, as recording paper 21 is thick and has an enhanced rigidity, recording paper 21 is carried to manual cutter 4 without jamming since the pressure applied to recording paper 21 by paper side regulating member 10*b* is adjusted based on the paper rigidity.

When this thick recording paper 21 is cut by manual cutter 4, the recording paper 21 is pulled so as to be shifted in the cut direction in the paper path as described above. The side of recording paper 21 pushes against paper side regulating member 10*b* to deform towards wire dot head 1 opposing the elastic force of paper side regulating member 10*b*. However, the rigidity of recording paper 21 and the pressure by paper side regulating member 10*b* cause recording paper 21 to return to the initial position after recording paper 21 is cut. As described above, recording paper 21 is not stuck out in the path of the carriage as in the case of thin recording paper, thus avoiding paper jamming.

Paper guide auxiliary plate 10 guides recording paper 21 up to the vicinity of the lower end of the printing area and further, and both sides of recording paper 21 are regulated from sticking out of the recording paper path by paper side regulating members 10*b*. Accordingly, even if an operator interferes with recording paper transportation, the recording paper is seldom forced out in the path of the carriage by the interference, thus preventing recording paper 21 from jamming as well as from ink sticking.

The effect according to the present invention can also be obtained in the case of a platen other than the platen in which a protruding portion is formed in the printing area described above. If, for example, in the case of a flat platen which does not have any protrusions in the width of the recording paper path, the height of gap forming member 10*d* formed on paper side regulating member 10*b* is set to be approximately equal to the thickness of the recording paper which can be used for the printer, the same effect can be obtained. In the embodiment, a dot impact printer is given as an example, however, in the case of an ink jet printer, the same effect can also be obtained.

Further, in the embodiment, gap forming member 10*d* is formed on paper side regulating member 10*b*, however, a projection may be also formed on platen frame 16 by embossing, or the projection may be formed as a separated part (for example, a rivet-shaped gap forming member attached on the platen frame).

Furthermore, paper guide auxiliary plate 10 formed of a solid material and paper side regulating member 10*b* formed of an elastic material may be also fixed together by welding or another method well known to those skilled in the art.

In addition, it is understood that the invention is not limited to the disclosed embodiment but, on the contrary, is intended to cover various modifications and equivalent arrangements included within the spirit and scope of the appended claims.

As described above, the practical benefits according to the present invention are great.

What is claimed is:

1. A printer comprising:

a platen member;

a paper guide auxiliary member for guiding recording paper supplied to a printing surface of said platen member;

a paper side regulating member for guiding a side portion of the recording paper passing through said paper guide auxiliary member; and a gap forming member located outside a recording paper path in which the recording paper is transferred and for providing a predetermined minimum gap between said paper side regulating member and the printing surface of said platen member;

wherein said gap forming member comprises a projection formed on one of said platen member and said paper side regulating member, said projection contacting the other one of said platen member and said paper side regulating member to maintain said predetermined minimum gap therebetween.

2. A printer according to claim 1, wherein said paper side regulating member is formed of an elastic material.

3. A printer according to claim 2, wherein said paper side regulating member is integral with said paper guide auxiliary member.

4. A printer according to claim 3, wherein said paper guide auxiliary member is made of thin stainless steel.

5. A printer according to claim 2, further comprising a manual cutter disposed downstream of the printing surface of said platen member in a direction in which the recording paper is transferred, and said paper side regulating member extends at least to said manual cutter along said recording paper path.

6. A printer according to claim 5, wherein said manual cutter comprises a skirt section for guiding into said recording paper path the leading edge of the recording paper transferred from said printing surface along said paper side regulating member.

7. A printer according to claim 6, wherein said manual cutter is disposed for pivotal motion, and said paper side regulating member biases said manual cutter so that said manual cutter is disposed at a predetermined position in which said skirt section of said manual cutter guides the recording paper into said recording paper path.

8. A printer according to claim 7, wherein said manual cutter comprises a blade and a shaft about which said manual cutter pivots;

and said shaft is disposed at the same height as said blade in the vertical direction.

9. A printer according to claim 7, wherein said manual cutter comprises a blade and a shaft about which said manual cutter pivots;

and said shaft is disposed at a position higher than said blade in the vertical direction.

10. A printer according to claim 1, wherein said platen member has a platen protruded therefrom forming the printing surface; and said gap forming member has a thickness equal to a sum of (a) a distance that said platen protrudes from said platen member and (b) said predetermined minimum gap.

11. A printer according to claim 1, wherein said projection has side surfaces and an end surface, and wherein said end surface of said projection contacts a major surface of an opposing one of said platen member and said paper side regulating member.

12. A printer comprising:

a platen member;

a paper guide auxiliary member for guiding recording paper supplied to a printing surface of said platen member;

a paper side regulating member for guiding a side portion of the recording paper passing through said paper guide auxiliary member; and a gap forming member located outside a recording paper path in which the recording paper is transferred and for providing a predetermined gap between said paper side regulating member and the printing surface of said platen member;

wherein said platen member has a platen protruding therefrom forming the printing surface; and said gap forming member has a thickness equal to a sum of (a) a distance that said platen protrudes from said platen member and (b) said predetermined gap.

13. A printer comprising:

a platen member;

a paper guide auxiliary member for guiding recording paper supplied to a printing surface of said platen member;

a paper side regulating member for guiding a side portion of the recording paper passing through said paper guide auxiliary member; and a gap forming member located outside a recording paper path in which the recording paper is transferred and for providing a predetermined gap between said paper side regulating member and the printing surface of said platen member;

wherein said paper side regulating member is formed of an elastic material;

said printer further comprising a manual cutter disposed downstream of the printing surface of said platen member in a direction in which the recording paper is transferred, and said paper side regulating member extends at least to said manual cutter along said recording paper path;

wherein said manual cutter comprises a skirt section for guiding into said recording paper path the leading edge of the recording paper transferred from said printing surface along said paper side regulating member; and wherein said manual cutter is disposed for pivotal motion, and said paper side regulating member biases said manual cutter so that said manual cutter is disposed at a predetermined position in which said skirt section of said manual cutter guides the recording paper into said recording paper path.

14. A printer according to claim 13, wherein said manual cutter comprises a blade and a shaft about which said manual cutter pivots;

and said shaft is disposed at the same height as said blade in the vertical direction.

15. A printer according to claim 13, wherein said manual cutter comprises a blade and a shaft about which said manual cutter pivots;

and said shaft is disposed at a position higher than said blade in the vertical direction.

* * * * *